US006820360B2

(12) United States Patent
Glazer

(10) Patent No.: US 6,820,360 B2
(45) Date of Patent: Nov. 23, 2004

(54) PICTURE FRAME WITH A STEPPED SUBSTRATE WALL HOLDING A DECORATIVE COVER ON THE FRAME

(76) Inventor: Thomas Glazer, 305 Spagnoli Rd., Melville, NY (US) 11747-3506

( * ) Notice: Subject to any disclaimer, the term of this patent is extended or adjusted under 35 U.S.C. 154(b) by 23 days.

(21) Appl. No.: 10/364,527

(22) Filed: Feb. 12, 2003

(65) Prior Publication Data

US 2004/0154206 A1 Aug. 12, 2004

(51) Int. Cl.[7] ..... A47G 1/06

(52) U.S. Cl. ..... 40/700; 40/732; 40/790; 40/798

(58) Field of Search ..... 40/700, 732, 768, 40/770, 790, 796, 798, 799

(56) References Cited

U.S. PATENT DOCUMENTS 460,663 A * 10/1891 Searvogle ..... 40/798
3,956,838 A * 5/1976 Gerrish ..... 40/799
4,079,529 A * 3/1978 Jennen et al. ..... 40/790
4,111,425 A * 9/1978 Lathrop ..... 40/768
4,286,400 A * 9/1981 MacPherson et al. ..... 40/799
4,450,636 A * 5/1984 Lasurdo ..... 40/799
4,794,714 A * 1/1989 Weisgerber ..... 40/768
5,640,793 A * 6/1997 Fischer ..... 40/732
6,472,038 B1 * 10/2002 Murphy ..... 40/798
2003/0196364 A1 * 10/2003 Chang ..... 40/732

* cited by examiner

*Primary Examiner*—Gary C. Hoge
(74) *Attorney, Agent, or Firm*—Young & Thompson

(57) ABSTRACT

A picture frame includes a frame with a decorative cover thereon. The frame has an opening through which a picture can be viewed and the cover extends from a top of the frame and around an interior edge of the opening to a bottom of the frame. The picture frame has an annular substrate that has an interior peripheral wall with plural steps ascending from the substrate and extending into the opening, where a riser of a top step abuts the interior edge of the opening to hold the cover between the riser and the frame, and where a flat of a bottom step abuts the bottom of the frame to hold the cover between the flat and the frame. A removably attachable back that holds a picture is provided in the opening.

14 Claims, 2 Drawing Sheets

PICTURE FRAME WITH A STEPPED SUBSTRATE WALL HOLDING A DECORATIVE COVER ON THE FRAME

BACKGROUND OF THE INVENTION

The present invention is directed to a picture frame that has a decorative cover.

A picture frame includes a frame with an opening through which a picture can be viewed. The frame may have cover made of leather or another useful or decorative material. One of the problems with such frames is that the cover is difficult to attach to the frame in a manner that is attractive. If the cover extends around the interior edge of the opening, the cover must be cut at the corners of the opening. Unless such cuts are made with great precision, overlapping seams or gaps in coverage may degrade the appearance of the cover. Indeed, from a practical standpoint, the required precision cannot be achieved cost effectively.

This problem is illustrated, by way of example, in FIG. 1 that shows a rear view of a frame 12 with a cover 14 folded around an interior edge 16 of the picture opening 18 and attached to a bottom 20 of the frame 12 (the front of the frame 12 is not shown). Unless the interior corners of the cover 14 are precisely aligned and cut, gaps 24 or overlapping seams 26 will appear at the corners of the interior edge 16 when viewed from the front of the frame 12.

Another problem of the prior art picture frames is that the cover may separate from the frame at the bottom of the frame so that a flap of loose edge appears in the opening. This is, of course, most unattractive and decreases the useful life of the picture frame.

SUMMARY OF THE INVENTION

An object of the present invention is to provide a novel picture frame and method that avoids the problems of the prior art.

A further object of the present invention is to provide a novel picture and frame and method in which a substrate for the frame has a stepped wall that covers an interior edge of the picture opening and holds the cover on the frame at the interior edge.

A yet further object of the present invention is to provide a novel picture frame that includes a frame with a cover thereon, where the frame has an opening through which a picture can be viewed, where an annular substrate has an interior peripheral wall with plural steps ascending from the substrate and extending into the opening, where a riser of an upper step abuts the interior edge of the opening to hold the cover between the riser and the frame, and where a flat of a lower step abuts the bottom of the frame to hold the cover between the flat and the frame.

Another object of the present invention is to provide a novel method of making a picture frame that includes the step of casting a single-piece annular substrate having an interior peripheral wall with plural steps ascending from the substrate and extending into the opening in the frame, and connecting the substrate to the frame so that a riser of a top one of the steps abuts the interior edge of the opening to hold the cover between the riser and the frame and so that a flat of a bottom one of the steps abuts the bottom of the frame to hold the cover between the flat and the frame.

These and other objects of the invention will apparent from the detailed description of the invention that follows and the attached drawings.

DESCRIPTION OF PREFERRED EMBODIMENTS

Figure 1:
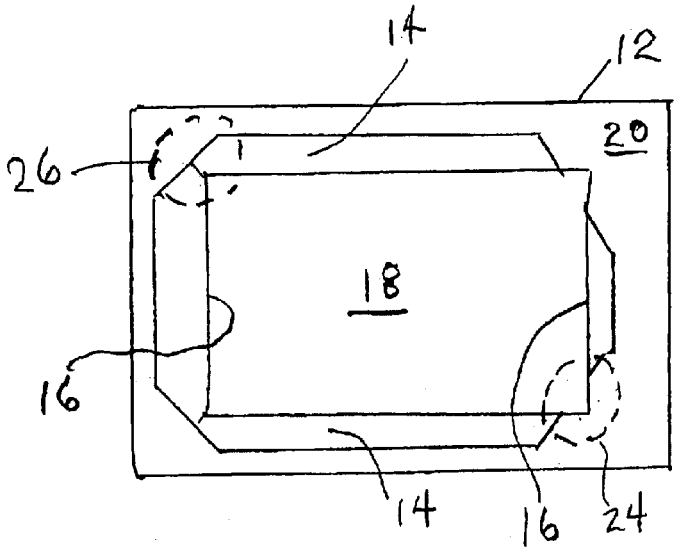
Figure 1 (PRIOR ART)
FIG. 1 illustrates the problem of attaching a cover to a conventional frame.
Figure 2:
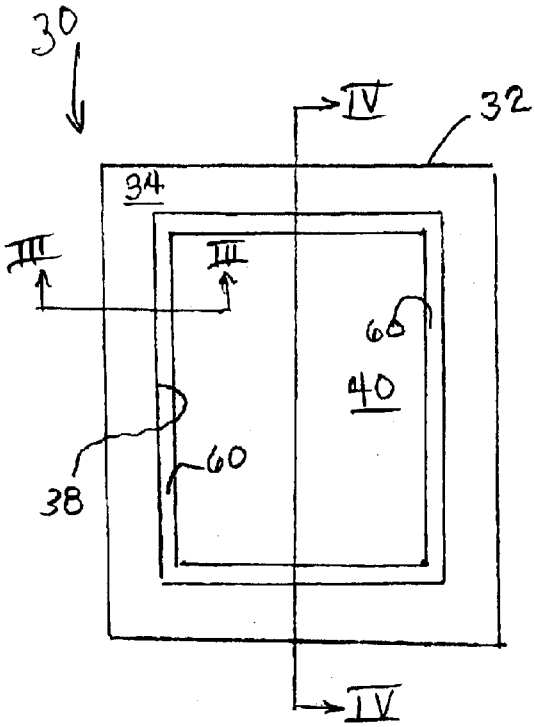
FIG. 2 is a top view of a first embodiment of a picture frame of the present invention.
Figure 3:
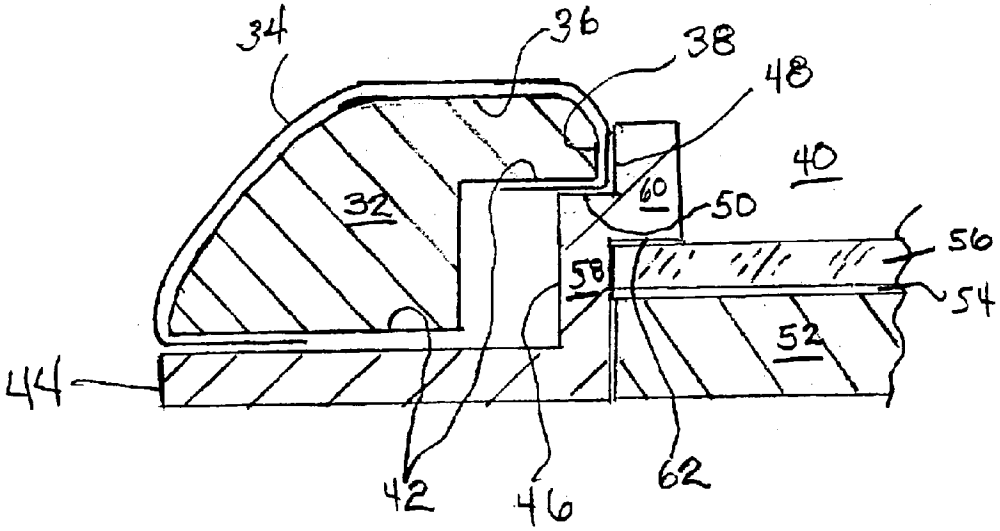
FIG. 3 is a cross sectional view of the first embodiment through line III—III in FIG. 2.

With reference now to FIGS. 2 and 3, a first embodiment of a picture frame 30 of the present invention includes a frame 32 with a cover 34 that extends over the top 36 of the frame 32, around the interior edge 38 of the opening 40, to the bottom 42 of the frame 32. Picture frame 30 also includes an annular substrate 44 having an interior peripheral wall 46 with plural steps ascending from the substrate 44 and extending into the opening 40. A riser 48 of an upper step abuts the interior edge 38 to hold the cover 34 between the riser 48 and the frame 32. A flat 50 of a lower step abuts the bottom 42 of the frame 32 to hold the cover 34 between the flat 50 and the frame 32.

A removably attachable back 52 holds a picture 54 and a transparent cover 56 in the opening 40.

By way of further explanation, a first elevated wall 58 that extends from a top surface of the substrate 44 and a second elevated wall 60 that extends from an interior edge of the top of the first wall 58 define the plural steps. The first elevated wall 58 has a top that defines a first ledge that forms the flat 50. The second elevated wall 60 extends into the opening 40. A bottom of the second wall 60 defines a second ledge 62 within the opening 40 for supporting the picture 54 and cover 56 in the opening 40. More than two steps may be provided, but two steps are preferred.

As is apparent, the stepped wall offers two places where the cover 34 can be held to the frame 32; namely, the exterior face of the second wall 60 that presses the cover 34 onto the interior edge 38 of the opening 40, and the flat 50 that presses the cover 34 onto the bottom 42 of the frame 32.

As seen in FIG. 2, the second wall 60 extends around an interior periphery of the opening 40, shielding from view the portion of the cover 34 that goes around the interior edge 38 and thereby covering any misaligned seams or gaps at the interior corners of the cover 34. The second wall 60 can be decoratively finished to present a pleasing appearance. For example, the second wall may be burnished metal that contrasts nicely with a leather cover.

Figure 5:
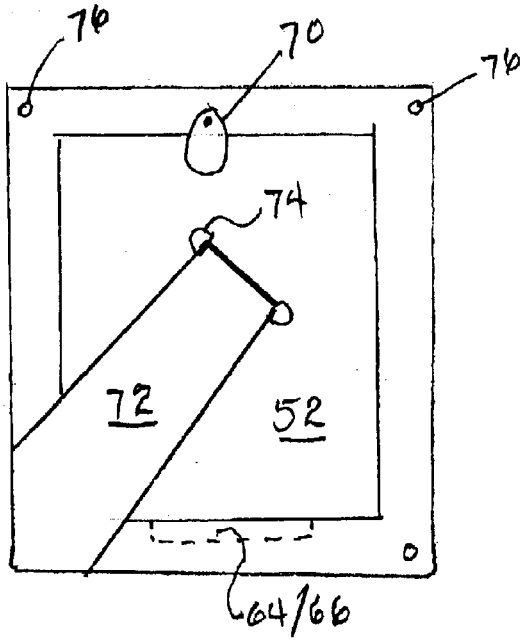
FIG. 5 is a rear view of an embodiment of the present invention.
Figure 4:
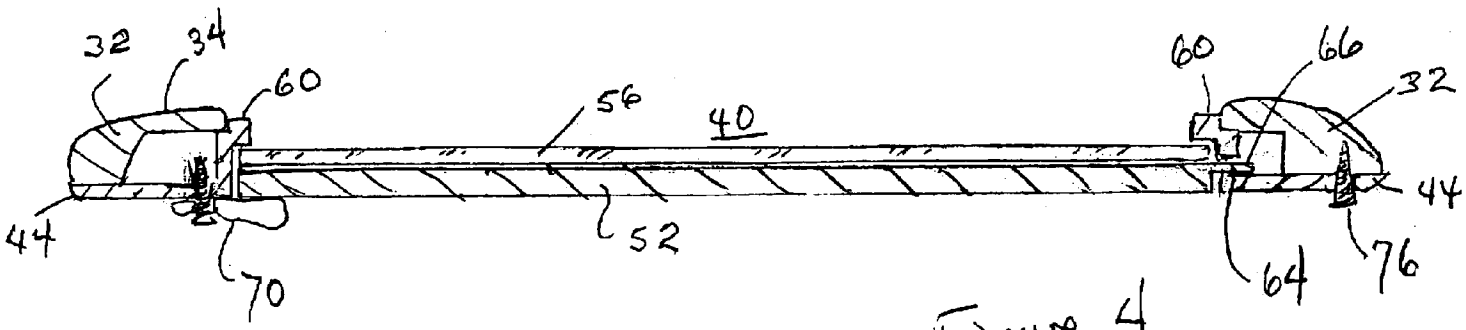
FIG. 4 is a cross sectional view of the first embodiment through line IV—IV in FIG. 2.

As shown in FIGS. 4 and 5, the first wall 58 has a slot 64 therein and the removable back 52 has a corresponding tongue 66 that is removably received in the slot 64 to hold the removable back 52 in the opening 40. The slot 64 may extend partly or completely through the first wall 58, depending on the thickness of the first wall and the length the tongue. A movable retainer 70 may be conventionally provided on the back of the frame to hold the removable back 52.

A support 72 may be pivotally attached to the removable back 52 with hinges 74 and may include a conventional arrangement for landscape and portrait alignments.

The substrate 44 may include suitable fasteners 76, such as screws, staples or the like, to attach the substrate 44 to the frame 32.

The frame 32 may be any suitable material including wood, plastic, or metal. As will be discussed below, the substrate 44 and plural steps 58, 60 may be a single piece of material such as cast metal, wood, or plastic. The removable back 52 may be a corresponding material. Metal substrate, steps, and back provide a particularly desirable weight and feel for the picture frame, especially when associated with a leather cover. By making the removable back 52 thicker and heavier than the substrate 44, the center of gravity of the picture frame is moved rearward to provide a more stable posture for the picture frame resting on the support 66. Alternatively, the plural steps 58, 60 may be separate from the annular frame and inserted into the opening.

The picture frame is shown in the drawings with a rectangular frame 32. Other frame shapes may be used, including polygon, circular, oval and may have rounded, instead of angled, corners. The present invention is applicable to any shape picture frame and the descriptions herein are not intended as limitations to frame shape.

A method of making the picture frame of the present invention includes the steps of placing the cover 34 on the frame 32 so that the cover 34 extends from the top of the frame 32 and around the interior edge of the opening 40 to the bottom of the frame, casting the substrate 44 and the plural steps 58 and 60 from a single-piece of metal or other suitable material, connecting the substrate to the frame so that the riser 48 abuts the interior edge of the opening 40 to hold the cover 34 between the riser 48 and the frame 32 and so that the flat 50 abuts the bottom of the frame 32 to hold the cover 34 between the flat 50 and the frame 32, and removably attaching the back 52 in the opening 40.

While various embodiments of the present invention have been described in the foregoing specification and drawings, it is to be understood that the present invention is defined by the following claims when read in light of the specification and drawings.

I claim:

1. A picture frame comprising:

a frame with a cover thereon, said frame having an opening for a picture, said cover extending from a top of said frame and around an interior edge of the opening to a bottom of said frame;

an annular substrate having an interior peripheral wall with plural steps ascending from said substrate and extending into said opening, a riser of an upper one of said steps abutting the interior edge of said opening to hold said cover between said riser and said frame, a flat of a lower one of said steps abutting said bottom of said frame to hold said cover between said flat and said frame; and a removably attachable back for holding a picture in said opening.

2. The picture frame of claim 1, wherein said interior peripheral wall has a slot therein and said back has a tongue that is removably received in said slot when said back is in said opening.

3. The picture frame of claim 1, wherein said substrate and said interior peripheral wall are a single piece of metal.

4. The picture frame of claim 1, wherein said plural steps are defined by a first elevated wall that extends from a top surface of said substrate and has a top that defines a first ledge, and a second elevated wall at said top of said first wall and that extends into said opening, a bottom of said second wall defining a second ledge within said opening for supporting a picture in said opening, an exterior face of said second wall being said riser of said upper one of said steps and said first ledge being said flat of said lower one of said steps.

5. The picture frame of claim 1, wherein said substrate has plural holes therethrough that are in registration with corresponding receptacles in said frame, and further comprising fasteners that extend through said holes into said receptacles to attach said substrate to said frame.

6. A picture frame, comprising:

a substrate with a first elevated wall that defines a first opening in said substrate for receiving a picture, said first wall extending from a top surface of said substrate and having a top that defines a first ledge, a bottom surface of said substrate being a back of the picture frame;

a second elevated wall at an interior side of said top of said first wall and that extends into said first opening, a bottom of said second wall defining a second ledge within the first opening for supporting a picture in the first opening;

a frame and a decorative cover on said frame, said frame having a second opening through which a picture supported on said second ledge is viewed, said second wall being within said second opening and abutting an interior edge of said second opening so that a portion of said cover on said interior edge of said second opening is held between said second wall and said frame, and said frame resting on said first ledge so that a portion of said cover on a bottom of said frame is held between said frame and said first ledge; and a removably attachable back that is received in the first opening to hold a picture between said second ledge and said back.

7. The picture frame of claim 6, wherein said first wall has a slot therein and said back has a tongue that is removably received in said slot when said back is received in the first opening.

8. The picture frame of claim 6, wherein said substrate is planar, said first wall extends perpendicular to said substrate and said second wall extends parallel to said first wall.

9. The picture frame of claim 8, wherein said first wall has an interior side to which an exterior side of said second wall is affixed.

10. The picture frame of claim 6, wherein longitudinal axes of said first and second walls are parallel to each other and displaced from each other.

11. The picture frame of claim 6, wherein said substrate and said first and second walls are a single piece of metal.

12. The picture frame of claim 6, wherein said cover extends over a top of said frame and around said interior edge of said second opening onto said bottom of said frame.

13. A method of making a picture frame, comprising the steps of:

placing a cover on a frame with an opening through which a picture can be viewed, the cover extending from a top of the frame and around an interior edge of the opening to a bottom of the frame;

casting a single-piece annular substrate having an interior peripheral wall with plural steps ascending from the substrate and extending into the opening;

connecting the substrate to the frame so that a riser of an upper one of the steps abuts the interior edge of the opening to hold the cover between the riser and the frame and so that a flat of a lower one of the steps abuts the bottom of the frame to hold the cover between the flat and the frame; and removably attaching a back in the opening.

14. The method of claim 13, wherein the plural steps are defined by a first elevated wall that extends from a top surface of the substrate and has a top that defines a first ledge, and a second elevated wall at the top of the first wall and that extends into the opening, a bottom of the second wall defining a second ledge within the opening for supporting a picture received in the opening, an exterior face of the second wall being the riser of the top step and the first ledge being the flat of the bottom step.

* * * * *